US005683620A

United States Patent [19]

Pialet

[11] Patent Number: 5,683,620

[45] **Date of Patent: *Nov. 4, 1997**

[54] ELECTRORHEOLOGICAL FLUIDS WITH HYDROCARBYL AROMATIC HYDROXY COMPOUNDS

[75] Inventor: Joseph W. Pialet, Euclid, Ohio

[73] Assignee: The Lubrizol Corporation

[ * ] Notice: The term of this patent shall not extend beyond the expiration date of Pat. No. 5,558,811.

[21] Appl. No.: 667,661

[22] Filed: Jun. 21, 1996

Related U.S. Application Data

[63] Continuation of Ser. No. 278,695, Jul. 21, 1994, Pat. No. 5,558,811, which is a continuation of Ser. No. 30,688, Mar. 12, 1993, abandoned.

[51] Int. Cl.[6] ..... C10M 171/00; C10M 169/04

[52] U.S. Cl. ..... 252/73; 252/74; 252/572

[58] Field of Search ..... 252/73, 74, 572

[56] References Cited

U.S. PATENT DOCUMENTS

| | | | |
|---|---|---|---|
| 3,047,507 | 7/1962 | Winslow | 252/75 |
| 4,687,589 | 8/1987 | Block et al. | 252/73 |
| 5,558,811 | 9/1996 | Pialet | 252/73 |

FOREIGN PATENT DOCUMENTS 1207315 7/1986 Canada .

*Primary Examiner*—Christine Skane
*Attorney, Agent, or Firm*—David M. Shold; Frederick D. Hunter

[57] ABSTRACT

A mixture of a carbon-based hydrophobic base fluid, an electrorheologically active solid particle, and an aromatic hydroxy compound substituted with a hydrocarbyl group containing at least about 6 carbon atoms shows good dispersion characteristics and good electrorheological activity.

23 Claims, No Drawings

ELECTRORHEOLOGICAL FLUIDS WITH HYDROCARBYL AROMATIC HYDROXY COMPOUNDS

This is a continuation of application Ser. No. 08/278,695 filed Jul. 21, 1994, now U.S. Pat. No. 5,558,811, which is in turn a continuation of Ser. No. 08/030,688 filed Mar. 12, 1993, now abandoned.

BACKGROUND OF THE INVENTION

The present invention relates to electrotheological fluids and devices, and a method for improving the dispersive stability of such fluids.

Electrorheological ("ER") fluids are fluids which can rapidly and reversibly vary their apparent viscosity in the presence of an applied electric field. ER fluids are generally dispersions of finely divided solids in hydrophobic, electrically non-conducting oils. They have the ability to change their flow characteristics, even to the point of becoming solid, when subjected to a sufficiently strong electrical field. When the field is removed, the fluids revert to their normal liquid state. ER fluids may be used in applications in which it is desired to control the transmission of forces by low electric power levels, for example, in clutches, hydraulic valves, shock absorbers, vibrators, or systems used for positioning and holding work pieces in position.

ER fluids have been known since 1947, when U.S. Pat. No. 2,417,508 was issued to Winslow, disclosing that certain dispersions of finely divided solids such as starch, carbon, limestone, gypsum, flour, etc., dispersed in a nonconducting liquid would undergo an increase in flow resistance when an electrical potential difference was applied. In the extensive work which has followed this discovery, many variations of ER fluids have been discovered, in which the solid phase, the liquid phase, or other components have been varied. One feature of many ER fluids is that a dispersant (also referred to as a surfactant) is required in order to maintain the finely divided solids dispersed through the liquid medium. The use of a dispersant, however, has been reported to lead to diminished electrorheological activity in some systems.

Among the various attempts to provide an improved ER fluid are the following:

Japanese application 03/170600 (Tonen Corp.), Jul. 24, 1991, discloses an electro-viscous fluid comprising an electric insulating fluid, porous solid particles, dispersant, and a polyhydric alcohol. The dispersants can include sulfonates, phenates, phosphonates, succinimides, amine, and nonionic dispersants including e.g. sorbitan monooleate.

Japanese application 04/120194 (Tonen Corp.), Apr. 21, 1992 (available as Derwent Abstract 92-180972/22), discloses electroviscous fluid containing at least one of partially etherified and esterified products of polyhydric alcohols in a base electroviscous fluid consisting of an electrically insulating fluid, porous solid particles, and dispersant. Dispersants include sulfonates, phenates, phosphonates, succinic imides, amines, and non-ionic dispersants.

European publication 395 359 (Tonen Corp.), Oct. 31, 1990, discloses an electrically insulating medium containing dispersed solid particles, an acid, base, or salt, a polyhydric alcohol, an antioxidant, and optionally an agent to assist dispersing of the solid particles (e.g. a sulfonate, phenate, phosphonate, succinic acid imide, amine or non-ionic dispersing agents).

European Application 342,041 (Toa Nenryo), Nov. 15, 1989, discloses an electrically insulating liquid, a porous solid particulate matter, water, and acid, base, Dr salt. A dispersant can also be used, for example, non-ionic dispersants such as sulfonates, phenates, phosphonates, succinic acid imides, and amines.

U.S. Pat. No. 2,970,573, Westhaver, Jul. 20, 1976, discloses electroviscous fluids comprising particles of modified starch dispersed in high concentration in a dielectric oil, the particles containing an electrolyte. Dispersants are also disclosed, usually of the water-in-oil type.

U.S. Pat. No. 3,367,872, Martinek et al., Feb. 6, 1968, discloses an electroviscous fluid comprising a non-polar oleaginous vehicle, such as a mineral oil, a particulate solid, and optionally other ingredients such as a surface active agent. Nonionic agents include ethers and esters formed by reaction of ethylene oxide with a variety of compounds such as fatty alcohols, alkyl phenols, glycol ethers, fatty acids, [etc.].

It has now been found that a certain class of dispersant imparts good dispersive stability to ER active particles in carbon-based fluids, while providing a fluid which maintains good ER activity.

SUMMARY OF THE INVENTION

The present invention provides an electrorheological fluid comprising (a) a carbon-based hydrophobic base fluid; (b) an electrorheologically active solid particle; and (c) an aromatic hydroxycompound substituted with a hydrocarbyl group containing at least 6 carbon atoms. The invention further comprises a process for improving the dispersive stability of an electrorheological fluid of a carbon-based hydrophobic base fluid and an electrorheologically active solid particle, said process comprising adding to the electrorheological fluid an aromatic hydroxy compound substituted with a hydrocarbyl group containing at least 6 carbon atoms. The invention further comprises electrorheological devices which contain a fluid of this type.

DETAILED DESCRIPTION OF THE INVENTION

The first component of the composition of the present invention is a carbon-based hydrophobic base fluid. The term "carbon-based" is intended to be approximately synonymous with "organic" and to refer to materials other than silicones (which can also be hydrophobic). This base fluid is a preferably a non-conducting, electrically insulating liquid or liquid mixture. Examples of such fluids include transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, and derivatives and mixtures thereof. The choice of the hydrophobic liquid phase will depend largely on practical considerations including compatibility of the liquid with other components of the system, solubility of certain components therein, and the intended utility of the ER fluid. For example, if the ER fluid is to be in contact with elastomeric materials, the hydrophobic liquid phase should not contain oils or solvents which affect those materials. Similarly, the liquid phase should be selected to have suitable stability over the intended temperature range, which in some cases may extend to 120° C. or even higher. Furthermore, the fluid should have a suitably low viscosity in the absence of a field that sufficiently large amounts of the dispersed phase, described below, can be incorporated into the fluid. Suitable liquids include those which have a viscosity at room temperature of 1 to 300 or 500 centistokes, or preferably 2 to 20 or 50 centistokes. Mixtures of two or more different non-conducting liquids can be used for the liquid phase. Mixtures can be selected to provide the desired viscosity, pour point, chemical and thermal stability, component solubility, etc. Useful liquids generally have as many of the following properties as possible: (a) high boiling point and low freezing point; (b) low viscosity so that the ER fluid has a low no-field viscosity and so that greater proportions of the solid dispersed phase can be included in the fluid; (c) high electrical resistance and high dielectric breakdown potential, so that the fluid will draw little current and can be used over a wide range of applied electric field strengths; and (d) chemical and thermal stability, to prevent degradation on storage and service.

Useful natural oils include animal oils and vegetable oils (e.g., castor oil, lard oil, and sunflower oils, including high oleic sunflower oil available under the name Trysun™ 80, rapeseed oil, and soybean oil) as well as liquid petroleum oils and hydrorefined, solvent treated, or acid-treated mineral lubricating oils of the paraffinic, naphthenic, and mixed paraffinic-naphthenic types. Oils derived from coal or shale are also useful.

Synthetic lubricating oils include alkylene oxide polymers and interpolymers and derivatives thereof where the terminal hydroxyl groups have been modified by esterification or etherification. They include polyoxyalkylene polymers prepared by polymerization of ethylene oxide or propylene oxide, the alkyl and aryl ethers of these polyoxyalkylene polymers, and mono- and polycarboxylic esters thereof, for example, acetic acid esters, mixed $C_3$–$C_8$ fatty acid esters, and $C_{13}$ oxo acid diester of tetraethylene glycol.

Another suitable class of synthetic liquids comprises the esters of monocarboxylic acids or dicarboxylic acids with a variety of alcohols and polyols. Monocarboxylic acids include e.g. hexanoic acid, heptanoic acid, octanoic acid, nonanoic acid, decanoic acid, undecanoic acid, dodecanoic acid, octadecanoic acid, stearic acid, oleic acid, and isomers of such acids. Dicarboxylic acids include e.g. phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkylmalonic acids, alkenyl malonic acids. Suitable alcohols include e.g., butyl alcohol, hexyl alcohol, dodecyl alcohol, 2-ethylhexyl alcohol, ethylene glycol, diethylene glycol monoether, and propylene glycol. Specific preferred examples of such esters include di-isodecyl azelate, available under the name Emery™ 2960, and isodecyl pelargonate, available under the name Emery™ 2911. These and other esters are well known to those skilled in the art.

Poly alpha olefins and hydrogenated poly alpha olefins (referred to sometimes as PAOs) are also useful in the present invention. PAOs are derived from alpha olefins containing 2 to 24 or more carbon atoms such as ethylene, propylene, 1-butene, isobutene, 1-decene, and so on. Specific examples include polyisobutylene having a number average molecular weight of 650, a hydrogenated oligomer of 1-decene having a viscosity of 8 cst at 100° C., ethylene propylene copolymers, and the like. An example of a hydrogenated poly alpha olefin is available under the name Emery™ 3004.

Other examples of possibly suitable liquids include liquid esters of phosphorus-containing acids such as tricresyl phosphate, trioctyl phosphate, and the diethyl ester of decylphosphonic acid.

The amount of the carbon-based hydrophobic base fluid is normally the amount required to make up 100% of the composition after the other ingredients are accounted for. Often the amount of the base fluid is 10–94.9 percent of the total composition, preferably 36–89 percent, and most preferably 56–79 percent. These amounts are normally percent by weight, but if an unusually dense dispersed solid phase is used, it may be more appropriate to determine these amounts as percent by volume.

The second major component of the ER fluid of the present invention is an electrorheologically active solid particle, which is to be dispersed in the liquid component. Many ER active solids are known, and any of these, as well as their equivalents, are considered to be suitable for use in the ER fluids of the present invention.

One preferred class of ER active solids includes carbohydrate based particles and related materials such as starch, flour, monosaccharides, and preferably cellulosic materials. The term "cellulosic materials" includes cellulose as well as derivatives of cellulose such as microcrystalline cellulose. Microcrystalline cellulose is the insoluble residue obtained from the chemical decomposition of natural or regenerated cellulose. Crystallite zones appear in regenerated, mercerized, and alkalized celluloses, differing from those found in native cellulose. By applying a controlled chemical pretreatment to destroy molecular bonds holding these crystallites, followed by mechanical treatment to disperse the crystallites in aqueous phase, smooth colloidal microcrystalline cellulose gels with commercially important functional and rheological properties can be produced. Microcrystalline cellulose can be obtained from FMC Corp. under the name Lattice™ NT-013. Amorphous cellulose is also useful in the present invention; examples of amorphous cellulose particles are CF1, CF11, and CC31, available from Whatman Specialty Products Division of Whatman Paper Limited, and Solka-Floc™, available from James River Corp. Other cellulose derivatives include ethers and esters of cellulose, including methyl cellulose, ethyl cellulose, hydroxyethyl cellulose, hydroxypropyl cellulose, sodium carboxymethyl cellulose, cellulose propionate, cellulose butyrate, cellulose valerate, and cellulose triacetate. Other cellulose derivatives include cellulose phosphates and cellulose reacted with various amine compound. Other cellulosic materials include chitin, chitosan, chondrointon sulfate, and viscose or cellulose xanthate. A more detailed listing of suitable cellulosics is set forth in copending U.S. application Ser. No. 07/823,489, filed Jan. 21, 1992 (Case 2598R).

In another embodiment, the ER active solid particles are particles of organic semiconductive polymers such as oxidized or pyrolyzed polyacrylonitrile, polyacene quinones, polypyrroles, polyphenylenes, polyphenylene oxides, polyphenylene sulfides, polyacetylenes, polyvinylpyridines, polyvinylpyrrolidones, polyvinylidene halides, polyphenothiazines, polyimidazoles, and preferably polyaniline, substituted polyanilines, and aniline copolymers. Compositions of the above and related materials, treated or doped with various additives including acids, bases, metals, halogens, sulfur, sulfur halides, sulfur oxide, and hydrocarbyl halides can also be employed. A more detailed description of certain of these materials can be found in copending U.S. application Ser. No. 07/774,397, filed Oct. 10, 1991 (case 2594R/B). A highly preferred organic polymeric semiconductor is polyaniline, particularly the polyaniline prepared by polymerizing aniline in the presence of an oxidizing agent (such as a metal or ammonium persulfate) and 0.1 to 1.6 moles of an acid per mole of aniline, to form an acid salt of polyaniline. The polyaniline salt is thereafter treated with a base to remove some or substantially all of the protons derived from the acid. A more complete description of polyaniline and its preferred method of preparation is set forth in copending U.S. application Ser. No. 07/774,398, filed Oct. 10, 1991 (case 2593R/B).

Inorganic materials which can be suitably used as ER active particles include carbonaceous powders, metals, semiconductors (based on silicon, germanium, and so on), barium titanate, silver germanium sulfide, ceramics, copper sulfide, carbon particles, silica gel, magnesium silicate, alumina, silica-alumina, pyrogenic silica, zeolites, and the like.

Another class of suitable ER active solid particles is that of polymeric salts, including silicone-based ionomers (e.g. the ionomer from amine functionalized diorganopolysiloxane plus acid), metal thiocyanate complexes with polymers such as polyethylene oxide, and carbon based ionomeric polymers including salts of ethylene/acrylic or methacrylic acid copolymers or phenol-formaldehyde polymers. Especially preferred is a polymer comprising an alkenyl substituted aromatic comonomer, a maleic acid comonomer or derivative thereof, and optionally additional comonomers, wherein the polymer contains acid functionality which is at least partly in the form of a salt. Preferably in such materials the maleic acid comonomer is a salt of maleic acid in which the maleic acid comonomer is treated with 0.5 to 2 equivalents of base. Most preferably this material is a 1:1 molar alternating copolymer of styrene and maleic acid, the maleic acid being partially in the form of the sodium salt. This material is described in more detail in copending U.S. application Ser. No. 07/878,797, filed Apr. 1, 1992 (case 2610R/B).

Other miscellaneous materials which can be used as ER active solid particles include fused polycyclic aromatic hydrocarbons, phthalocyanine, flavanthrone, crown ethers and salts thereof, including the products of polymeric or monomeric oxygen- or sulfur-based crown ethers with quaternary amine compounds, lithium hydrazinium sulfate, and ferrites.

Certain of the above mentioned solid particles are customarily available in a form in which a certain amount of water or other liquid polar material is present. This is particularly true for polar organic particles such as cellulose or ionic polymers. These liquid polar materials need not necessarily be removed from the particles, but they are not generally required for the functioning of the present invention. The acceptable amounts of such liquid polar material is discussed in more detail below.

The particles used in the ER fluids of the present invention can be in the form of powders, fibers, spheres, rods, core-shell structures, etc. The active material can be an ER-active core which is covered by an insulative or protective shell or an inert core which is covered by an ER-active shell.

The size of the particles of the present invention is not particularly critical, but generally particles having a number average size of 0.25 to 100 μm, and preferably 1 to 20 μm, are suitable. The maximum size of the particles would depend in part on the dimensions of the electrorheological device in which they are intended to be used, i.e., the largest particles should normally be no larger than the gap between the electrode elements in the ER device.

The amount of such polymer particles in the ER fluid should be sufficient to provide a useful electrorheological effect at reasonable applied electric fields. However, the amount of particles should not be so high as to make the fluid too viscous for handling in the absence of an applied field. These limits will vary with the application at hand: an electrorheologically active grease, for instance, would desirably have a higher viscosity in the absence of an electric field than would a fluid designed for use in e.g. a valve or clutch. Furthermore, the amount of particles in the fluid may be limited by the degree of electrical conductivity which can be tolerated by a particular device, since the polymeric particles normally impart at least a slight degree of conductivity to the total composition. For most practical applications the polymeric particles will comprise 5 to 60 percent by weight of the ER fluid, preferably 10 to 50 percent by weight, and most preferably 15 to 35 percent by weight. Of course if the nonconductive hydrophobic fluid is a particularly dense material such as carbon tetrachloride or certain chlorofluorocarbons, these weight percentages could be adjusted to take into account the density. Likewise if the particles themselves are particularly dense, such as certain compounds of barium, they may necessarily be present in a larger percentage by weight. Practical considerations might dictate that a volume percent concentration calculation would be more appropriate in such circumstances. Determination of such an adjustment would be within the abilities of one skilled in the art.

The third major component of the ER fluid of the present invention is an aromatic hydroxy compound substituted with a hydrocarbyl group containing at least 6 carbon atoms. The term "aromatic hydroxy compound" includes phenols (which are preferred), bridged phenols, in which the bridging group is an oxygen atom, a sulfur atom, a nitrogen atom, a carbon atom (including an alkylene group), and the like, as well as phenols directly linked through covalent bonds (e.g. 4,4'-bis(hydroxy)biphenyl), hydroxy compounds derived from fused-ring hydrocarbons (e.g., naphthols and the like); and polyhydroxy compounds such as catechol, resorcinol and hydroquinone. Mixtures of one or more hydroxyaromatic compounds also may be used. When the term "phenol" is used herein, it is thus to be understood that this term is not intended to limit the aromatic group of the phenol to benzene. Accordingly, it is to be understood that the aromatic group as represented by "Ar" may be mononuclear or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The aromatic hydroxy compound can likewise contain one or more hydroxy groups; most commonly, however, there will be only one hydroxy group on each aromatic nucleus.

The aromatic hydroxy compound is substituted with at least one, and preferably not more than two, hydrocarbyl groups containing at least 6 carbon atoms. As used herein, the term "hydrocarbyl substituent" or "hydrocarbyl group" means a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms. The presence of the hydrocarbyl group is believed to impart to the compound a degree of compatibility with the carbon-based hydrophobic base fluid, so that the compound can effectively function as a dispersant.

Suitable hydrocarbyl groups include cycloalkyl groups, aromatic groups, aromatic-substituted alkyl groups and alkyl-substituted aromatic groups. Other suitable hydrocarbyl groups include substituents derived from any of the polyalkenes including polyethylenes, polypropylenes, polyisobutylenes, ethylene-propylene copolymers, chlorinated olefin polymers and oxidized ethylene-propylene copolymers. It is preferred that the hydrocarbyl substituent be an alkyl substituent. More preferably the alkyl group will contain 9 to 100 carbon atoms, and more preferably still 20 to 30 carbon atoms. Preferred hydrocarbyl groups include polyisobutyl groups and polypropyl groups having the desired number of carbon atoms.

Examples of suitable hydrocarbyl-substituted hydroxyaromatic compounds include the various naphthols, the various alkyl-substituted catechols, resorcinols, and hydroquinones, the various xylenols, the various cresols, aminophenols, and the like. Examples of various suitable compounds include hexylphenol, heptylphenol, octylphenol, nonylphenol, decylphenol, dodecylphenol, tetrapropylphenol, eicosylphenol, polyisobutylphenol, polypropylphenol, and the like. Examples of suitable hydrocarbyl-substituted thiol-containing aromatics include hexylthiophenol, heptylthiophenol, octylthiophenol, nonylthiophenol, dodecylthiophenol, tetrapropylthiophenol, and the like. Examples of suitable thiol- and hydroxyaromatic compounds include dodecylmonothio-resorcinol, 2-mercaptoalkylphenol where the alkyl group is as set forth above.

The hydrocarbyl substituted aromatic hydroxy compound, whether mononuclear, polynuclear, bridged, etc., can further contain other substituents. Among the possible substituents are alkyl groups containing fewer than 6 carbon atoms, carboxyl groups, amino groups, hydroxy groups, alkylenehydroxygroups, ester groups, nitro groups, halogen groups, nitrile groups, ketone groups, and aldehyde groups.

The amount of the hydrocarbyl-substituted aromatic hydroxy compound in the present invention is an amount sufficient to improve the dispersive stability of the composition. Normally the effective amount will be 0.1 to 20 percent by weight of the fluid, preferably 0.4 to 10 percent by weight of the fluid, and most preferably 1 to 5 percent by weight of the fluid.

Hydrocarbyl-substituted aromatic hydroxy compounds are prepared by methods which are well known to those skilled in the art, such as by alkylation of aromatic hydroxy compounds. Such methods are discussed in the article entitled "Alkylation of Phenols," in Kirk-Othmer "Encyclopedia of Chemical Technology," Second Edition, Volume 1, page 894 to 895, Interscience Publishers, division of John Wiley and Company, N.Y., 1963.

Example A. Synthesis of surfactant

One thousand parts by weight phenol and 64 parts by weight Amberlyst 15™ sulfonic acid functionalized resin (semi dry) are charged to a reactor at 52°–60° C. The contents are heated with stirring under a stream of nitrogen and maintained at 125°–130° C. for two hours. To the reactor is added 1116 parts propylene tetramer and the mixture is maintained at temperature for three hours. Agitation is stopped and, after settling for 30 minutes the reaction mixture is sent to a stripping column where volatiles are removed. The resulting produce contains less than 0.5% residual propylene tetramer and less than 1% residual phenol.

Example B. Synthesis of surfactant

Example A is substantially repeated except as follows: One thousand parts by weight of synthetic phenol and 50 parts Super Filtrol™ Grade 1, a sulfuric acid-impregnated filter aid, are charged to a reactor and heated to 50° C. Propylene tetramer, 1,226 parts, is rapidly added, with stirring, maintaining the temperature below 60° C. Stirring is discontinued and the material is allowed to settle for 4 hours. The material separates into two layers; the upper layer is decanted, filtered, and stripped, to yield the product. The lower layer, which is largely the filter aid, is recharged with sulfuric acid and used as a heel for subsequent batches.

Example C. Synthesis of surfactant

Example B is substantially repeated except that the starting materials are 126 parts by weight phenol and 1000 parts by weight $C_{24}$–$C_{28}$ olefin fraction from Gulf.

Example D. Synthesis of surfactant

Two hundred seventy-five parts by weight phenol and 126 parts toluene are charged to a reactor and the contents heated to 49° C. Seven and one-half parts $BF_3$ are introduced to the reactor with stirring through a submerged line, maintaining the temperature below 55° C. One thousand parts by weight polyisobutylene are added while maintaining the temperature at 38° C. maximum. The contents are maintained at 35°–38° C. for 8 hours. Lime is added to neutralize the excess $BF_3$, and the contents are filtered.

The contents are subjected to stripping followed by vacuum stripping at 150°–270° C. to provide the desired product.

The composition of the present invention can further contain other additives and ingredient which are customarily used in such fluids. Most importantly, it can contain a polar activating material other than the three aforementioned components.

As has been mentioned above, certain of the ER-active particles, such as cellulose or polymeric salts, commonly have a certain amount of water associated with them. This water can be considered such a polar activating material. The amount of water present in the compositions of the present invention is typically 0.1 to 30 percent by weight, based on the solid particles. More generally the amount of polar activating material (which need not be water) will be 0.1 to 10 percent by weight, based on the entire fluid composition, preferably 0.5 to 4%, and most preferably 1.5 to 3.5 weight percent, based on the fluid. The polar activating material can be introduced to the ER fluid as a component of the solid particles (such as absorbed water), or it can be separately added to the fluid upon mixing of the components. Whether the polar activating material remains dispersed through the bulk of the ER fluid or whether it associates with the solid particles is not precisely known in every case, but such details are not essential to the functioning of the present invention. Indeed, even the presence of a polar activating material is not essential to the functioning of the fluids of the present invention or to the dispersant characteristics of the surfactant. Rather it is observed that some ER fluid systems function more efficiently when the polar activating material is present. Accordingly, it is sometimes desirable not to dry cellulose thoroughly before it is used in the ER fluids of the present invention. On the other hand, for fluids which will be exposed to elevated temperatures during their lifetime, it is often desirable that no water or other volatile material be present. For such applications the use of an alternative polar material, having Significantly lower volatility, can be useful. Suitable polar activating materials include water, other hydroxy-containing materials as alcohols and polyols, including ethylene glycol, glycerol, 1,3-propanediol, 1,4-butanediol, 1,5-pentanediol, 2,5-hexanediol, 2-ethoxyethanol, 2-(2-ethoxyethoxy)ethanol, 2-(2-butoxyethoxy)ethanol, 2-(2-methoxyethoxy)ethanol, 2-methoxyethanol, 2-(2-hexyloxyethoxy)ethanol, and glycerol monooleate, as well as amines such as ethanolamine and ethylenediamine. Other suitable materials are carboxylic acids such as formic acid and trichloroacetic acid. Also included are such aprotic polar materials as dimethylformamide, dimethylsulfoxide, propionitrile, nitroethane, ethylene carbonate, propylene carbonate, pentanedione, furfuraldehyde, sulfolane, diethyl phthalate, and the like.

While the polar material is believed to be normally physically adsorbed or absorbed by the solid ER-active particles, it is also possible to chemically react at least a portion of the polar material with the polymer. This can be done, for example, by condensation of alcohol or amine functionality of certain polar materials with an acid or anhydride functionality on the polymer or its precursor.

The ER fluids of the present invention find use in clutches, valves, dampers, positioning equipment, and the like, where it is desirable to vary the apparent viscosity of the fluid in response to an external signal. Such devices can be used, for example, to provide an automotive shock absorber which can be rapidly adjusted to meet the road conditions encountered during driving.

EXAMPLES

Examples 1–19

Compositions with the following surfactants are examined at 20° and 60°, and the yield stress (in kPa) is measured in the presence of a 6 kV/mm field using a Couette test apparatus. In the Couette testing, data is gathered using a custom horizontal concentric cylinder electrorheometer. The shear stress is determined by measuring the torque required to rotate an inner cylinder separated from an outer cylinder by the ER fluid. Because this rheometer uses a lip seal, some seal drag is apparent in the measurements. The shear rate is determined from the rotation rate assuming couette flow. This device has a shear rate range of 20 to 1000 $s^{-1}$. The electrode gap is 1.25 mm. The rheometer can evaluate fluids over the temperature range of −20° to 120° C.

For each sample tested, the composition contains 25% by weight cellulose which in turn contains 2% or 3.5% water (by Karl Fischer), and 3% by weight of the indicated surfactant, in a medium of Emery 2960™ diisodecyl azelate.

TABLE I

| Ex. | Surfactant |
|---|---|
| 1* | none |
| 2 | $C_{24-28}$ alkyl-substituted phenol |
| 3 | polyisobutylene (row 940) - substituted phenol |
| 4 | propylene tetramer substituted phenol |
| 5 | matl. of Ex. 2, formaldehyde coupled |
| 6 | polypropylene (500 $M_n$) - alkylated phenol |
| 7* | glycerol monooleate |
| 8* | 3-decyloxysulfone |
| 9* | sodium alkyl sulfonate |
| 10* | nonylphenoxypoly(ethyleneoxy)ethanol |
| 11* | sorbitan sesquioleate |
| 12* | diethoxylated oleyl alcohol |
| 13* | ethoxylated oleic acid (600 MW) |
| 14* | oleylamine |
| 15* | oleic acid |
| 16* | ester of polyisobutenyl succinic anhydride with pentaerythritol |
| 17* | bis(2-hydroxyethyl)tallowamine |
| 18* | Hypermer KD3[a] |
| 19* | polyisobutenylsuccinic anhydride adduct with poly(ethyleneamines) |

[a] -- polymeric dispersant from ICI, structure not known.
* -- designates a comparative example The results of the testing show that the samples in which the surfactants of the present invention are employed exhibit high yield stress in the presence of the electric field.

Examples 20–49.

Samples as indicated in Table II are prepared and tested as in Example 1. In each of these Examples the solid is cellulose, dried under vacuum at 150° C. for 16–18 hours to provide a water level of less than 1% except as noted. The polar activator is ethylene glycol, and the surfactant is an alkyl phenol having 24–28 carbon atoms in the alkyl group, except as noted. The base fluid is Emery™ 2960 (diisodecyl azelate) or Emery™ 2911 (isodecyl pelargonate), as indicated:

TABLE II

| Ex. | Cellulose, % | % Eth.Gly. | Surfactant | Base fluid |
|---|---|---|---|---|
| 20* | 25 | 1.50 | 0 | Emery ™ 2960 |
| 21 | 30 | 2.00 | 3.0 | Emery ™ 2911 |
| 22 | 30 | 2.25 | 3.0 | Emery ™ 2911 |
| 23 | 30 | 2.50 | 3.0 | Emery ™ 2911 |
| 24 | 30 | 2.75 | 3.0 | Emery ™ 2911 |
| 25 | 10 | 0.90 | 2.0 | Emery ™ 2960 |
| 26 | 10 | 0.90 | 4.0 | Emery ™ 2960 |
| 27 | 10 | 0.5 | 4.0 | Emery ™ 2960 |
| 28 | 10 | 2.0 | 2.0 | Emery ™ 2960 |
| 29 | 10 | 0.5 | 2.0 | Emery ™ 2960 |
| 30 | 10 | 0.9 | 4.0 | Emery ™ 2960 |
| 31 | 10 | 2.0 | 4.0 | Emery ™ 2960 |
| 32 | 30 | 2.0 | 3.0 | Emery ™ 2960 |
| 33 | 30 | 1.5 | 3.0 | Emery ™ 2960 |
| 34 | 30 | 1.75 | 3.0 | Emery ™ 2960 |
| 35 | 30 | 0.9 | 3.0 | Emery ™ 2960 |
| 36 | 30 | 0.9 | 2.0 | Emery ™ 2960 |
| 37 | 30 | 0.5 | 4.0 | Emery ™ 2960 |
| 38 | 30 | 1.5 | 4.0 | Emery ™ 2960 |
| 39 | 30 | 2.25 | 3.0 | Emery ™ 2960 |
| 40 | 15[a] | 1.0 | 3.0 | Emery ™ 2960 |
| 41 | 25[a] | 1.0 | 3.0 | Emery ™ 2960 |
| 42 | 25 | 1.25 | 3.0 | Emery ™ 2960 |
| 43 | 25 | 1.0 | 3.0 | Emery ™ 2960 |
| 44 | 30 | 1.5 | 3.0 | Emery ™ 2911 |
| 45 | 30 | 3.25 | 3.0 | Emery ™ 2911 |
| 46 | 30 | 1.25 | 3.0 | Emery ™ 2911 |
| 47* | 25 | 1.25 | 0 | Emery ™ 2960 |
| 48* | 25 | 1.25 | 3.0[b] | Emery ™ 2960 |
| 49 | 25 | 1.25 | 3.0[c] | Emery ™ 2960 |

* -- comparative example
[a] -- dried 6.5 hours at 170° C.
[b] -- surfactant is glycerol monooleate
[c] -- surfactant is polyisobutylphenol The examples within the scope of the invention show good electrorheological activity.

Examples 50–59

Samples as indicated in Table III are prepared and tested in an oscillating duct flow apparatus. In this apparatus data is gathered using an oscillating test fixture which pumps the ER fluid back and forth between parallel plate electrodes as the field is increased to 6 kV/mm. The shear stress is determined by measuring the force required to move the fluid through the electrodes. The mechanical amplitude is ±1 mm and the electrode gap is 1 mm. The mechanical frequency range is 0.5 to 30 Hz, which produces a shear rate range of 600 to 36,000 $s^{-1}$. The shear rate is calculated at the wall of the electrodes assuming Poiseuille flow. The apparatus is capable of testing a fluid over the temperature range of −20° to 120° C. In each of these Examples the solid is polyaniline, used at 20 percent by weight; the surfactant, used at 3 percent by weight, is as indicated. No polar activator is used. The base fluid is Emery™ 2960 (diisodecyl azelate), Emery™ 2911 (isodecyl pelargonate), or Emery™ 3004 PAO (hydrogenated poly-alpha olefin) as indicated:

TABLE III

| Ex. | Base Fluid | Surfactant |
|---|---|---|
| 50* | Emery ™ 2960 | none |
| 51 | Emery ™ 2960 | $C_{12}$ alkyl substituted phenol |
| 52 | Emery ™ 2960 | $C_{24-28}$ alkyl substituted phenol |
| 53* | Emery ™ 3004 PAO | none |
| 54 | Emery ™ 3004 PAO | $C_{24-28}$ alkyl substituted phenol |
| 55* | Emery ™ 2911 | none |
| 56 | Emery ™ 2911 | $C_{24-28}$ alkyl substituted phenol |
| 57* | Emery ™ 2911 | glycerol monooleate |
| 58* | Emery ™ 2960 | glycerol monooleate |
| 59* | Emery ™ 3004 PAO | glycerol monooleate |

* -- comparative examples

The results show good electrorheological properties when the surfactant of the present invention is used.

Examples 60–62.

The procedure of Examples 50–59 is repeated except that the solid particle is the sodium salt of a 1:1 molar alternating copolymer of maleic anhydride and styrene, containing about 5 percent adsorbed water, and present in an amount of 40 weight percent of the ER fluid. In each case the base fluid is Emery 3004 PAO. The surfactant used is as shown in Table IV.

TABLE IV

| Example | Surfactant type | Surfactant amount |
|---|---|---|
| 60* | none | 0 |
| 61* | glycerol monooleate | 3 |
| 62 | $C_{24-28}$ alkyl phenol | 3 |

* -- a comparative example

The results show good electrorheological properties when the surfactant of the present invention is used.

Each of the documents referred to above is incorporated herein by reference. Except in the Examples, or where otherwise explicitly indicated, all numerical quantities in this description specifying amounts of materials or reaction conditions are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. As used herein, the expression "consisting essentially of" permits the inclusion of substances which do not materially affect the basic and novel characteristics of the composition under consideration.

What is claimed is:

1. An electrorheological fluid comprising:

(a) a carbon-based hydrophobic base fluid selected from the group consisting of synthetic hydrocarbon fluids;

(b) electrorheologically active solid particles; and (c) an aromatic hydroxy compound substituted with a hydrocarbyl group containing at least 9 carbon atoms.

2. The electrorheological fluid of claim 1 wherein the electrorheologically active solid particle is a carbohydrate-based solid particle.

3. The electrotheological fluid of claim 1 wherein the electrorheologically active solid particle is an organic semiconducting polymer.

4. The electrorheological fluid of claim 3 wherein the organic semiconducting polymer is polyaniline or poly (substituted aniline).

5. The electrorheological fluid of claim 1 wherein the electrorheologically active solid particle is an inorganic material.

6. The electrorheological fluid of claim 1 wherein the aromatic hydroxy compound is further substituted by at least one substituent selected from the group consisting of alkyl groups containing less than about 6 carbon atoms, carboxygroups, amino groups, hydroxygroups, and alkylenehydroxy groups.

7. The electrorheological fluid of claim 1 wherein the aromatic hydroxy compound is an alkyl phenol, the alkyl group containing about 9 to about 100 carbon atoms.

8. The electrorheological fluid of claim 7 wherein the alkyl group contains about 20 to about 30 carbon atoms.

9. The electrorheological fluid of claim 7 wherein the alkyl group is polyisobutyl or polypropyl.

10. The electrorheological fluid of claim 1 wherein the aromatic hydroxy compound contains a plurality of aromatic nuclei bridged by at least one sulfur atom, oxygen atom, nitrogen atom, or alkylene group.

11. The electrorheological fluid of claim 1 further comprising (d) a polar activating material other than the materials of (a)–(c).

12. The electrorheological fluid of claim 11 wherein the polar activating material is water.

13. The electrorheological fluid of claim 11 wherein the polar activating material is an organic polar compound.

14. The electrorheological fluid of claim 13 wherein the polar activating material is ethylene glycol.

15. The electrorheological fluid of claim 11 wherein the amount of the polar activating material is about 0.1 to about 10 weight percent of the fluid.

16. The electrorheological fluid of claim 11 wherein the amount of polar activating material is about 0.1 to about 30 percent by weight of the electrorheologically active solid particles.

17. The electrorheological fluid of claim 1 wherein the amount of the electrorheologically active solid particles is about 5 to about 60 percent and the amount of the aromatic hydroxy compound is about 0.1 to about 20 percent by weight of the fluid.

18. An electrorheological device comprising a means for applying an external signal to vary the apparent viscosity of the fluid of claim 1 contained therein.

19. A process for improving the dispersive stability of an electrorheological fluid of a carbon-based hydrophobic base fluid selected from the group consisting of synthetic hydrocarbon fluids, and electrorheologically active solid particles, said process comprising adding to the electrotheological fluid an aromatic hydroxy compound substituted with a hydrocarbyl group containing at least about 9 carbon atoms.

20. The process of claim 19 wherein the synthetic hydrocarbon fluid is a hydrogenated polyalphaolefin.

21. A method for increasing the apparent viscosity of a fluid comprising (a) a carbon-based hydrophobic base fluid selected from the group consisting of synthetic hydrocarbon fluids;

(b) electrotheologically active solid particles; and (c) an aromatic hydroxy compound substituted with a hydrocarbyl group containing at least 9 carbon atoms said method comprising subjecting the fluid to an electric field.

22. The method of claim 21 wherein the synthetic hydrocarbon fluid is a hydrogenated polyolefin.

23. An electrotheological fluid comprising:

(a) a hydrogenated polyalphaolefin;

(b) electrorheologically active solid particles; and (c) an aromatic hydroxy compound substituted with a hydrocarbyl group containing at least 9 carbon atoms.

* * * * *